United States Patent [19]

Marold

[11] 4,420,955

[45] Dec. 20, 1983

[54] PERMUTATION LOCK

[75] Inventor: Ulrich Marold, Hinterzarten, Fed. Rep. of Germany

[73] Assignee: Theodor Kromer GmbH & Co. KG, Umkirch, Fed. Rep. of Germany

[21] Appl. No.: 287,825

[22] Filed: Jul. 28, 1981

[30] Foreign Application Priority Data

Aug. 6, 1980 [DE] Fed. Rep. of Germany ..... 3029735

[51] Int. Cl.[3] ..... E05B 37/08

[52] U.S. Cl. ..... 70/303 A; 70/314

[58] Field of Search ..... 70/314, 303 A, 302, 70/303 R

[56] References Cited

U.S. PATENT DOCUMENTS

| | | | |
|---|---|---|---|
| 144,670 | 11/1873 | Gross | 70/314 |
| 491,159 | 2/1893 | Craig | 70/314 |
| 2,436,859 | 3/1948 | Eras | 70/314 |
| 2,645,923 | 7/1953 | Behrens | 70/303 A |
| 3,176,486 | 4/1965 | Richardson | 70/303 A |
| 3,339,382 | 9/1967 | Miller | 70/314 |
| 3,572,069 | 3/1971 | Junkune | 70/314 |

FOREIGN PATENT DOCUMENTS

| | | | |
|---|---|---|---|
| 2816969 | 10/1979 | Fed. Rep. of Germany | 70/303 A |
| 1175730 | 12/1969 | United Kingdom . | |

*Primary Examiner*—Robert L. Wolfe

*Attorney, Agent, or Firm*—Kontler, Grimes & Battersby

[57] ABSTRACT

A permutation lock wherein a locking bolt is reciprocable in a housing between extended and retracted position. The housing contains a set of coaxial tumblers rotatable by a cam having a lobe which can move the bolt to extended position through the medium of a coupling lever which is pivotally connected with the bolt. The coupling lever can be pivoted to an operative position, in which it extends into the path of movement of the lobe on the cam, only when at least one of the tumblers is moved from a predetermined position in which a notch in its peripheral surface is out of alignment with similar notches in the peripheral surfaces of the other tumblers. The bolt is movable to the retracted position by a locating lever which is pivoted to the bolt and has a pallet receivable in a recess of the lobe only when all of the notches are aligned with each other so that they can receive a finger which is provided on the locating lever and extends in parallelism with the common axis of the tumblers.

43 Claims, 5 Drawing Figures

Fig. 1
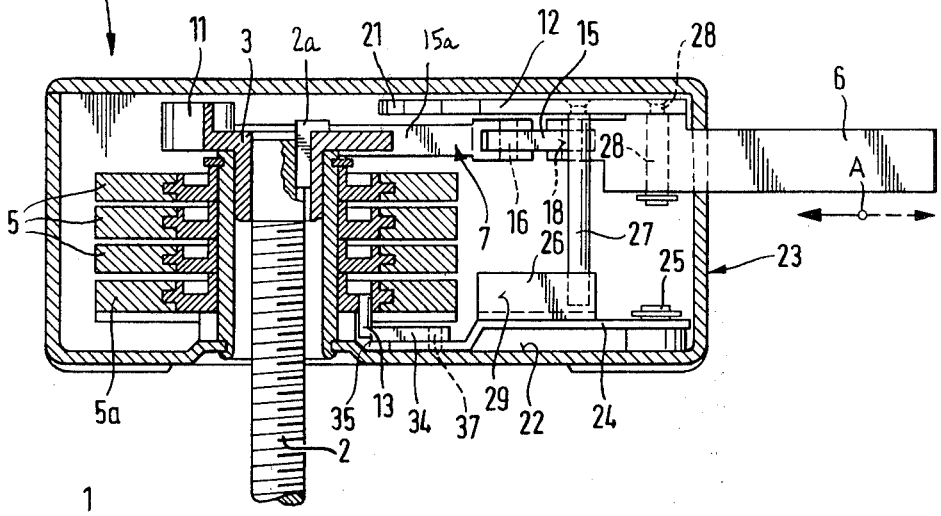
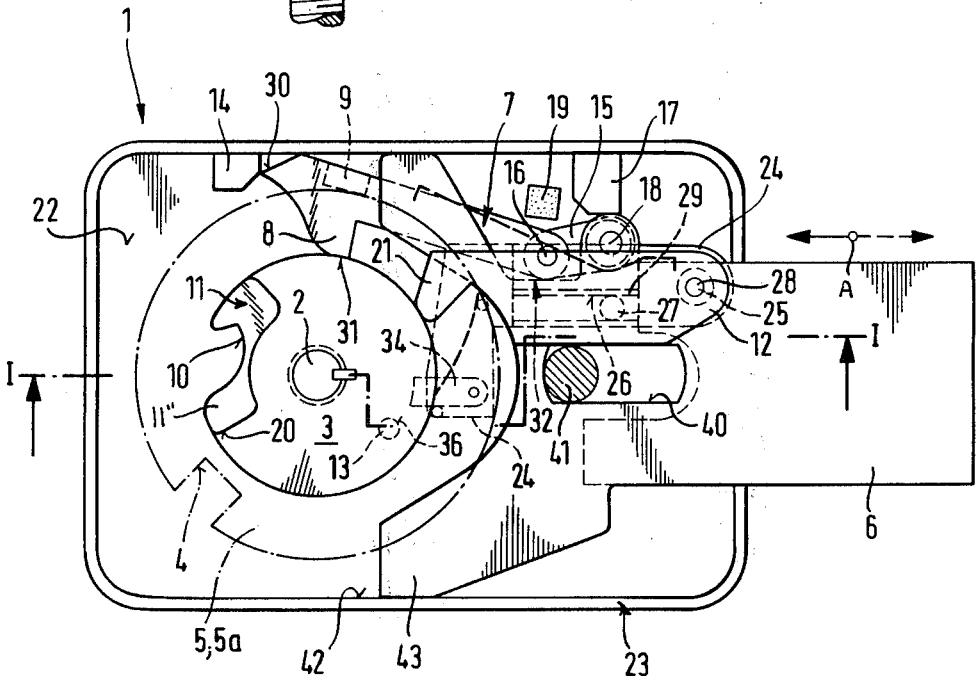
Fig. 2

Fig. 3
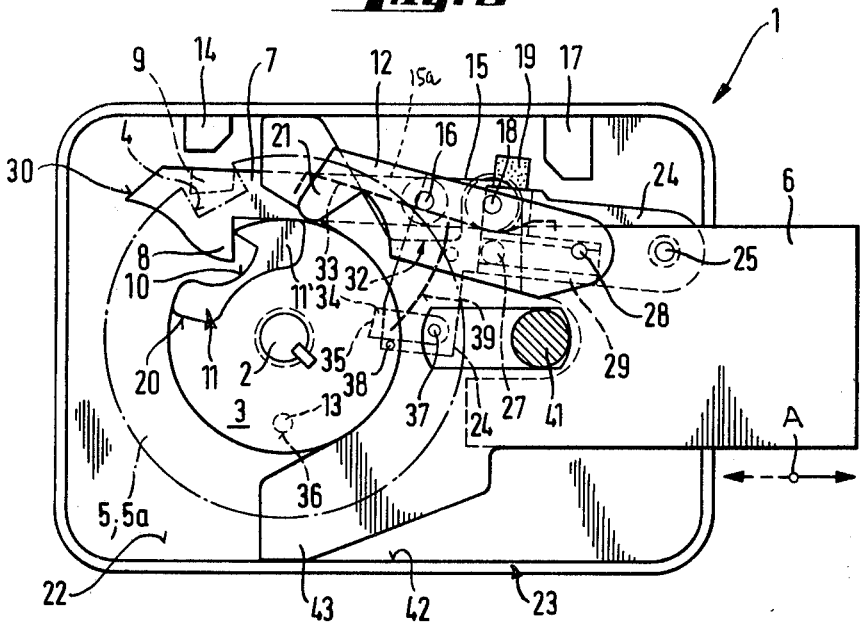
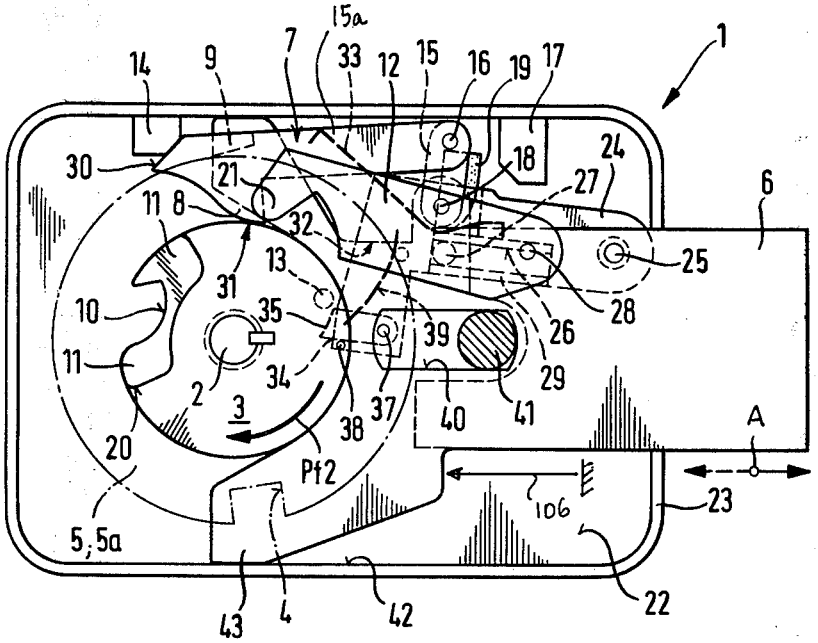
Fig. 4

PERMUTATION LOCK

BACKGROUND OF THE INVENTION

The present invention relates to permutation locks in general, and more particularly to improvements in permutation locks of the type wherein the tumblers may constitute or resemble discs and are movable to predetermined positions by a rotary actuating unit which includes a cam having a peripheral notch or cutout for a portion of a locating device which is articulately connected with the locking bolt and can be moved into engagement with the tumblers only when the tumblers assume predetermined angular positions corresponding to the selected combination.

Permutation locks of the above outlined character are described in German Offenlegungsschriften Nos. 23 20 816 and 28 16 969. The locks which are disclosed in these publications are constructed and assembled in such a way that the locking bolt can be moved to its extended position in response to rotation of the cam while the tumblers remain in the aforementioned predetermined angular positions. This contributes to convenience of manipulation of the permutation lock because it is not necessary to adjust the positions of the tumblers prior to each opening of the lock, i.e., prior to each retraction of the locking bolt from its extended position. However, such mode of operation also reduces the reliability of the permutation lock, i.e., an unauthorized person is much more likely to rapidly open the lock than if the positions of the tumblers necessitate adjustment prior to each retraction of the bolt.

OBJECTS AND SUMMARY OF THE INVENTION

An object of the invention is to provide a permutation lock which is constructed and assembled in such a way that the position or positions of one or more tumblers must be changed before the locking bolt is moved to its retracted position.

Another object of the invention is to provide a permutation lock wherein all of the tumblers must be caused to change their positions preparatory to opening of the lock so that such opening can be effected only by a person who is familiar with the combination.

A further object of the invention is to provide the permutation lock with novel and improved means for transmitting motion to the locking bolt.

An additional object of the invention is to provide the permutation lock with novel and improved means for maintaining the tumblers in proper positions preparatory to initiation of movement of the bolt with reference to the housing.

An ancillary object of the invention is to provide a permutation lock which is constructed and assembled in such a way that the likelihood of successful manipulation of the lock by unauthorized persons is reduced or eliminated in a simple and inexpensive manner.

Another object of the invention is to provide a permutation lock which is constructed and assembled with a view to prevent an unauthorized person from learning the combination when the locking bolt is held in the retracted or extended position.

A further object of the invention is to provide a permutation lock wherein the rotary and reciprocable components, especially the tumblers and the locking bolt, are operatively connected or connectable with each other in a novel and improved way.

The invention is embodied in a permutation lock which comprises a preferably sturdy or very sturdy housing, a locking bolt which is installed in and is movable (preferably reciprocable) with reference to the housing between extended (locking) and retracted positions, a plurality of rotary tumblers in the housing (such tumblers may resemble or constitute discs which are rotatable about a common axis and have peripheral surfaces provided with notches), means for rotating the tumblers relative to each other to and from predetermined angular positions (in which the aforementioned notches of all disc-shaped tumblers are aligned with each other, as considered in parallelism with the common axis of the tumblers), a rotary cam which is provided in the housing and constitutes a component part of the aforementioned rotating means, locating means which is movable in the housing into engagement with the cam only when all of the tumblers assume their predetermined positions and which is arranged to effect a movement of the locking bolt to one of its positions (preferably to the retracted position) in response to rotation of the cam, and a coupling device movable in the housing to and from an operative position in which the coupling device moves or effects a movement of the locking bolt to the other position (preferably to the extended position) in response to rotation of the cam. One of the tumblers has means (e.g., a post or an analogous projection) for effecting (e.g., by way of a suitable mechanism, such as a linkage) a movement of the coupling device to the operative position in response to movement of the one tumbler from its predetermined position so that such movement of the one tumbler must precede the movement of the bolt to the other position because the coupling device cannot assume its operative position when all of the tumblers assume their predetermined positions.

The cam has a peripheral surface which is preferably provided with a recess and the locating means preferably includes a first portion (e.g., a pallet) receivable in the recess of the cam and a second portion (e.g., a finger extending in parallelism with the common axis of disc-shaped tumblers) receivable in the notches only in the predetermined positions of all tumblers so that each movement of the bolt to the one position (under the action of or in response to initiation by the locating means) must be preceded by a movement of all of the tumblers to their predetermined positions in order to enable the first portion of the locating means to enter the recess of the cam and the second portion of the locating means to enter the notches of all tumblers. The arrangement is preferably such that the first portion of the locating means cannot enter the recess unless all of the notches are aligned with one another so as to permit entry of the second portion of the locating means and vice versa. The locating means may comprise a lever, and the lock then preferably further comprises pivot means (e.g., a pin, post or shaft) for articulately connecting the lever to the locking bolt.

The cam preferably comprises a suitably configurated lobe or an analogous motion transmitting portion which is arranged to move along an arcuate path (preferably along an endless circular path whose center is located on the common axis of the tumblers). The coupling device is interposed between a portion of the path for such motion transmitting portion and the locking bolt in the operative position of the coupling device. Still further, the lock preferably comprises means for connecting the coupling device directly to the locking bolt. If the coupling device constitutes or comprises a lever, the just mentioned connecting means may comprise a pivot member which articulately connects the coupling lever with the locking bolt.

As mentioned above, the means for effecting a movement of the coupling device to its operative position in response to movement of at least one tumbler from its predetermined position may comprise a projection (e.g., a post) on the one tumbler, and such post is then movable along an arcuate path (preferably along an endless circular path whose center is located on the common axis of the tumblers). The lock then further comprises a mechanism (e.g., a linkage) for pivoting the coupling lever to the operative position under the action of the post in response to rotation of the one tumbler from its predetermined position. One component (e.g., a pawl) of the just mentioned mechanism or linkage extends into the path of movement of the post when the coupling lever is out of the operative position while the one tumbler is rotated away from its predetermined position so that such rotation of the one tumbler entails a movement of the coupling lever to its operative position under the action of the one component which is engaged and displaced by the post of the one tumbler.

The locating means may comprise a lever of variable effective length having a first section or arm which is articulately connected with the bolt by a first pivot pin and a second section or arm which is articulately connected with the first section by a second pivot pin so that the locating lever can be extended or shortened (jackknifed) by pivoting at least one of the sections with reference to the other section. The aforementioned lobe of the cam can constitute a means for reducing the length of the locating lever in the retracted position of the locking bolt and in response to rotation of the cam in a direction to move the one tumbler from its predetermined position preparatory to movement of the coupling device to its operative position. The housing then comprises a stop and the locating lever (preferably the second section of such lever) comprises a portion (e.g., a tip of the second section) which engages the stop in response to a reduction of the length of the locating lever by the cam. Such reduction of the length entails or is accompanied by a movement of the first portion of the locating lever away from the recess of the cam and by simultaneous movement of the second portion of the locating lever away from the notches of the tumblers. The cam can pivot the first section of the locating lever relative to the bolt in a first direction by way of the second section. The housing further contains an abutment which is located in the path of movement of the first section of the locating lever (when the latter is shortened) with the bolt while the bolt moves toward its extended position so that the first section of the locating lever is pivoted in a second direction counter to the first direction in response to movement of the bolt to its extended position. This restores the length of the locating lever so that the latter can be prepared for entrainment of the bolt to the retracted position as soon as all of the tumblers are caused to reassume their predetermined positions.

The novel features which are considered as characteristic of the invention are set forth in particular in the appended claims. The improved lock itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a horizontal sectional view of a permutation lock which embodies one form of the invention, with the bolt shown in an end elevational view and with the tumbler adjusting knob omitted;

FIG. 2 is an elevational view of the lock with the front part of the housing omitted, with the bolt shown in extended position and with a guide pin for the bolt shown in section;

FIG. 3 illustrates the structure of FIG. 2 but with the bolt in retracted position;

FIG. 4 illustrates the structure of FIG. 3 but with certain parts shown in the positions they assume during a first stage of their movement toward positions which entail a movement of the bolt to the extended position.

DESCRIPTION OF THE PREFERRED EMBODIMENTS

Figure 5:
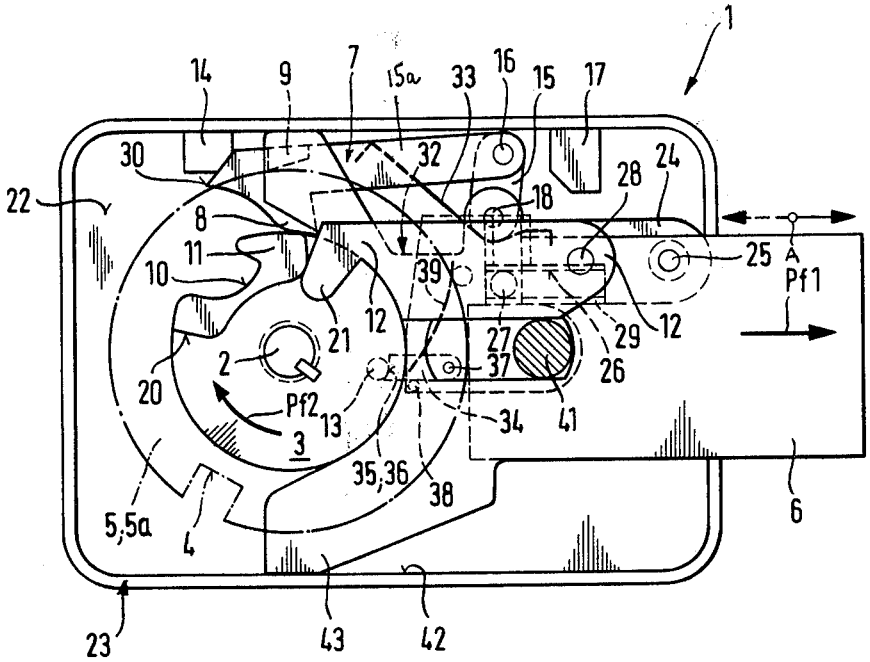
FIG. 5 illustrates the structure of FIG. 4 but during a further stage of movement of certain parts immediately preceding the movement of the bolt to the extended position of FIG. 1 or 2.

Referring first to FIGS. 1 and 2, there is shown a permutation lock 1 (hereinafter called lock for short) which comprises a box or housing 23 for a substantially flat locking bolt 6 movable relative to the housing between an extended position shown in FIGS. 1–2 and a retracted position shown in FIGS. 3 to 5. The directions in which the bolt 6 is reciprocable between such positions are indicated by the double-headed arrow A. The housing 23 further contains a set of coaxial rotary disc-shaped tumblers 5 and **5*a* which have peripheral surfaces provided with recesses or notches 4 and which are movable to and from predetermined angular positions (in which the notches 4 of all tumblers are accurately aligned with each other, as considered in parallelism with the common axis of the tumblers) by a rotating means including a knob or the like (not shown) secured to a shaft 2 which is keyed to a disc-shaped cam 3 having a peripheral recess or notch 10 movable into alignment with the notches 4. The connection between the cam 3 and the shaft 2 comprises at least one key 2*a*. A locating lever 7 which is articulately connected with the bolt 6 has a first portion or pallet 8 receivable in the recess 10 when the tumblers 5 assume their predetermined positions and the angular position of the cam 3 is such that it recess 10 registers with the notches 4. The manner in which rotation of the shaft 2 entails movements of the tumblers 5 to and from the just discussed predetermined positions is not specifically shown in the drawing; the sequence and the direction in which the shaft 2 must be rotated to move the notches 4 into alignment with each other depends on the selected combination of the permutation lock 1. When the pallet 8 of the lever 7 does not extend into the recess 10, its bears or abuts against the peripheral surface of the cam 3. The locating lever 7 further comprises a second portion or finger 9 which is parallel to the axis of the shaft 2 and extends into the notches 4 when the tumblers 5 assume their predetermined positions and the pallet 8 is free to enter the recess 10. The cam 3 comprises a motion transmitting portion or lobe 11 which serves to indirectly move the locking bolt 6 to the extended position shown in FIGS. 1 and 2**.

The improved lock 1 further comprises a coupling device 12 which can cooperate with the lobe 11 of the cam 3 to move the bolt 6 to the extended position of FIGS. 1 and 2 in response to rotation of the cam 3 in a clockwise direction (see the arrow Pf2) beyond the angular position shown in FIG. 5. The coupling device 12 is a lever having at its left-hand end, as viewed in the drawing, a rounded projection or pallet 21 which can be moved into and from the path of orbital movement of the lobe 11 on the cam 3. In accordance with a feature of the invention, at least one of the tumblers 5 and 5*a* (in the illustrated embodiment the lowermost tumbler 5*a*, as viewed in FIG. 1) must be moved from its predetermined position before the coupling lever 12 can be pivoted to the operative position of FIG. 5 in which its pallet 21 is located in the path of movement of the lobe 11 on the cam 3. This ensures that the tumbler 5*a* must be reset to its predetermined position before the locking bolt 6 can be retracted from its extended position, i.e., the person who can open the lock by retracting the bolt 6 must know the selected combination which must be relied upon in order to move all of the tumblers (including the selected tumbler 5*a*) to the aforementioned predetermined positions. The right-hand end portion of the coupling lever 12 is articulately connected with the locking bolt 6 by a pivot pin 28 whose axis is parallel to that of the shaft 2. The selected tumbler 5*a* has a portion 13 (e.g., a post or pin which is parallel to the shaft 2) serving to effect or to allow for a movement of the coupling lever 12 to the operative position of FIG. 5 in which the pallet 21 is located in the path of orbital movement of the oncoming lobe 11 so that rotation of the cam 3 in the direction of arrow Pf2 entails a movement of the locking bolt 6 to the extended position of FIGS. 1 and 2. This further means that, before the operator of the lock 1 can move the bolt 6 from the retracted position shown in FIGS. 3 to 5 to the extended position which is shown in FIGS. 1 and 2, at least one of the tumblers 5, 5*a* (namely, at least the tumbler 5*a*) must be caused to change its angular position in response to rotation of the shaft 2 and cam 3 so that the alignment of notches 4 in all four tumblers 5 and 5*a* is terminated before the locking bolt 6 can be moved to the extended position in which its outermost portion extends into a complementary part affixed to a door frame or the like. Consequently, when a person thereupon desires to return the locking bolt 6 to the retracted position of FIGS. 3 to 5, such person must be familiar with the combination in order to be capable of returning all of the tumblers 5 and 5*a* to their predetermined positions in which the pallet 8 can enter the recess 10 and the finger 9 can enter all of the notches 4.

As mentioned above, the rotating means including the shaft 2, the non-illustrated handle or knob on the shaft 2, and the cam 3 is arranged to move each and every one of the four tumblers 5, 5*a* to its predetermined position by following the selected combination. The rotating means includes tumbler displacing means (the parts of such displacing means are indicated in FIG. 1) for rotating the tumblers in response to rotation of the cam 3. The arrangement is such that, before the cam 3 can rotate the tumbler 5*a* (which is remotest therefrom) from the predetermined position of such tumbler, all other tumblers (i.e., those denoted in FIG. 1 by the reference character 5 and including a topmost tumbler 5 located nearest to the cam and two additional tumblers located between the topmost tumbler and the tumbler 5*a*) must be moved from their predetermined positions.

As can be readily seen in the drawing, particularly in FIG. 4, the illustrated locating lever 7 comprises two sections or arms 15, 15*a* which are articulately connected to each other by a pivot pin 16 extending in parallelism with the shaft 2. The relatively short section or arm 15 of the locating lever 7 is articulately connected with the locking bolt 6 by a further pivot pin 18 which is parallel to the pin 16. The longer section or arm 15*a* of the locating lever 7 carries the aforementioned pallet 8 and the finger 9. The feature that the locating lever 7 is assembled of two relatively movable sections or arms 15 and 15*a* enables this lever to change its effective length, i.e., the distance between the pivot pin 18 on the coupling lever 12 and the pallet 8. The locating lever 7 must be caused to pivot its arm 15*a* clockwise, as viewed in FIG. 5, in order to move its tip or edge portion 30 against a stop 14 before the lobe 11 can cooperate with the coupling lever 12 to shift the locking bolt 6 to the extended position of FIGS. 1 and 2. Expulsion of the pallet 8 from the recess 10 of the cam 3 precedes the movement of the tumbler 5*a* to the angular position of FIG. 5 in which the lobe 11 is free to engage the coupling lever 12. The configuration of the cam 3 is such that, when this cam is rotated in the direction of arrow Pf2 from the angular position of FIG. 3 toward and beyond the angular position of FIG. 4, the cam 3 expels the lobe 8 from its recess 10 so that the tip 30 approaches the stop 14 which is provided in and secured to the housing 23, namely, to one of the narrower wall portions of the housing. Thus, the finger 9 is removed from the notches 4 of the tumblers 5 before the coupling lever 12 assumes the operative position of FIG. 5, i.e., the cam 3 causes the finger 9 to leave the notches 4 as a result of expulsion of the pallet 8 from the recess 10.

In the extended position of the locking bolt 6, the pivot pin 16 is located at a level below the pivot pin 18 (see FIG. 2 and let it be assumed that the locking bolt 6 is horizontal or nearly horizontal). When the locating lever 7 is shortened, the pivot pin 16 is moved to a level above the pin 18 (see FIGS. 4 and 5) so as to provide room for engagement of the tip 30 with the stop 14. The effective length of the locating lever 7 is increased in automatic response to movement of the locking bolt 6 to the extended position of FIGS. 1 and 2, i.e., in response to movement of the locking bolt from the position of FIG. 5 to the position of FIG. 2, because the interconnected portions of the arms 15 and 15*a* of the lever 7 in the region of the pivot pin 16 then move against a stationary abutment 17 at the inner side of the housing 23 and compel the lever 7 to move from the "jackknifed" position of FIG. 5 to the flattened or lengthened position of FIG. 2 in which the pivot pin 16 is located at a level below the pivot pin 18. The direction in which the locking bolt 6 must move (to its extended position) in order to move the interconnected portions of the arms 15, 15*a* against the stationary abutment 17 is indicated by the arrow Pf1 shown in FIG. 5. Such movement of the locking bolt 6 takes place in response to rotation of the cam 3 in the direction of arrow Pf2 whereby the lobe 11 engages the coupling lever 12 which is then held in the operative position of FIG. 5 and begins to move in a direction to the right so that the pivot pin 28 transmits motion to the bolt 6. The pivot pin 18 shares all movements of the bolt 6 and, since the pivot pin 16 is arrested by the abutment 17, the lever 7 is compelled to increase its effective length. The abutment 17 need not effect a full stretching of the lever 7 to the position of FIGS. 1 and 2, i.e., it suffices that the abutment 17 initiate a counterclockwise pivotal movement of the arm 15, as viewed in FIG. 5, whereupon the pivot pin 16 descends by gravity and moves to a level below the pivot pin 18. If the manufacturer of the lock 1 does not desire to rely on gravity alone or if the lock 1 is mounted in such position that the locking bolt 6 is movable along a substantially vertical path, the housing 23 preferably comprises or contains a suitable spring or other means for biasing the locating lever 7 to the position of greater effective length as soon as the bolt 6 reaches a certain intermediate position between the retracted position of FIG. 5 and the extended position of FIG. 2. In the illustrated embodiment, the means for biasing the lever 7 to the position of greater effective length comprises a torsion spring 33 which is indicated by a heavy line and may be coiled around the pivot pin 18.

The portion or post 13 on the selected tumbler 5*a* can be replaced with a socket, hole or recess for reception of a pin or post on the coupling lever 12 without departing from the spirit of the invention. As stated above, the post 13 is provided on the lowermost tumbler 5*a* of FIG. 1, i.e., on that tumbler which is remotest from the cam 3. Since the neighboring tumblers are coupled to each other in a manner not forming part of the present invention, and since the post 13 is provided on the tumbler 5*a* which is remotest from the cam 3, all of the tumblers must be moved from their predetermined positions before the selected tumbler 5*a* can be turned to the extent which is necessary to enable the pallet 21 of the coupling lever 12 to cooperate with the lobe 11 of the cam 3. In other words, all of the tumblers 5 and 5*a* must be moved from their predetermined positions before further rotation of the cam 3 (in the direction of the arrow Pf2) results in or causes a movement of the locking bolt 6 from the retracted position of FIG. 5 to the extended position of FIG. 2. Consequently, it is impossible to open the lock 1, i.e., to move the locking bolt 6 from the extended position of FIG. 2 to the retracted position of FIG. 3, without being familiar with the combination, namely, with the required sequence and extent of angular movements of the shaft 2 and cam 3 in order to return all of the tumblers to their predetermined positions so that the finger 9 of the locating lever 7 can enter the notches 4 of all four tumblers (it goes without saying that the number of tumblers can be reduced to less than or increased above four without departing from the purview of the present invention). Furthermore, and since all of the tumblers 5, 5*a* must be moved from their predetermined positions before the coupling lever 12 moves its pallet 21 into the path of movement of the oncoming lobe 11, it is practically impossible to estimate, calculate or ascertain the various numbers of the selected combination unless the person who manipulates the lock 1 is actually familiar with such combination.

The coupling lever 12 is movable between two predetermined positions (hereinafter called end positions or operative and second positions in order to distinguish from the (extended and retracted) positions of the locking bolt 6 and from the (collapsed of full-length) positions of the locating lever 7). The arrangement is such that the coupling lever 12 can be releasably fixed or held in each of its two end positions. To this end, the housing 23 of the lock 1 can contain suitable detent means (such as a spring-biased spherical detent member which is installed in a selected portion of the coupling lever 12 and enters a first detent notch in one end position or a second detent notch in the other end position of the lever 12) which is not specifically shown in the drawing. When the coupling lever 12 assumes one of its end positions (see FIG. 3 or 4), its pallet 21 is located at a level above and away from the path of orbital movement of the lobe 11 on the cam 3. In the other end position of the coupling lever 12 (see FIG. 5), the pallet 21 is nearer to the shaft 2 and can be engaged by the front side face of the oncoming lobe 11. A permanent magnet 19 or another suitable retaining device can be provided in the housing 23 to releasably hold the coupling lever 12 in the one end position (i.e., in that end position in which the pallet 21 cannot be engaged by the lobe 11). The mounting of the magnet 19 is preferably such that it can reliably retain the coupling lever 12 in the one end position but cannot influence the lever 12 when the latter assumes the other end position or operative position (in which the pallet 21 can be engaged by the lobe 11). In this respect, the permanent magnet 19 is preferable to a spring which permanently biases the lever 12 irrespective of the momentary end position of such lever. However, this does not exclude the possibility of utilizing a spring which is connected with the lever 12 in such a way that it exerts at least some force when the lever is held in the one end position, i.e., in that end position in which the pallet 21 is remote from the path of movement of the lobe 11. The force of such spring is then effective to oppose the movement of the coupling lever 12 from its one end position.

Instead of cooperating directly with the coupling lever 12, the magnet 19 can cooperate with the component 24 and/or 34 of a mechanism which is interposed between the post 13 of the tumbler 5*a* and the lever 12 to move the latter to the operative position in response to rotation of the tumbler 5*a* from its predetermined position.

The configuration of the surface on the lobe 11 of the cam 3 is such that its rounded portion 20 which is located at the locus of transition of the just mentioned surface into the peripheral surface of the cam 3 can engage the rounded edge face of the pallet 21 on the coupling lever 12 during movement of the locking bolt 6 to the retracted position whereby the surface portion 20 causes the coupling lever 12 to pivot towards its one end position so that it can be retained by the magnet 19. When the cam 3 is rotated in a direction counter to that indicated by the arrow Pf2, the surface portion 20 can engage the pallet 21 and pivots the lever 12 clockwise, as viewed in FIG. 2, 3, 4 or 5, from the other end position of FIG. 2 back to the one end position which is shown in FIG. 3. The lever 12 is then attracted by the permanent magnet 19 and remains in the one end position until it is caused to leave such position in order to return into the path of movement of the lobe 11.

The mechanism or linkage which moves the coupling lever 12 to its operative position, i.e., which causes the pallet 21 of the lever 12 to move into the path of movement of the lobe 11 on the cam 3 when the latter is rotated in the direction of arrow Pf2, comprises a first component here shown as a control lever 24 pivotably mounted on a pin 25 which is secured to a major side wall 22 of the housing 23, namely, to that one of the two major side walls which is nearer to the tumbler 5*a* and more distant from the cam 3. The control lever 24 can be indirectly engaged by the post or motion transmitting portion 13 of the tumbler 5*a* and has an elongated guide slot or track 26 for a pin 27 of the coupling lever 12 (see particularly FIG. 1). The pin 27 constitutes a means for movably connecting the control lever 24 with the coupling lever 12 and forms part of a pin-and-slot connection 26, 27. The pivot pin 28 for the coupling lever 12 could be made rigid with the pivot pin 25 and the latter with the coupling lever 12 so that all pivotal movements of the control lever 24 would be transmitted directly to the coupling lever.

In the embodiment which is shown in FIGS. 1 to 5, the control lever 24 is a piece of sheet metal (a prefabricated stamping) which is formed partly by stamping or punching and partly by bending (deforming) so that the aforementioned guide slot or track 26 is flanked by two parallel cheeks 29 extending substantially at right angles to the general plane of the control lever. It is equally possible to make the control lever 24 in the form of a flat stamping and to thereupon weld or solder the cheeks 29 to such component.

The locking bolt 6 is permanently acted upon by a biasing device 106 which is shown in FIG. 4 and urges the bolt toward the retracted position (i.e., counter to the direction which is indicated by the arrow Pf1). Such biasing device preferably comprises a spring whose bias exceeds the force which tends to reduce the effective length of the locating lever 7. This ensures that, when the bolt 6 is readily slidable between its extended and retracted positions, a shortening of the lever 7 by the lobe 11 will not entail a premature partial or complete expulsion of the bolt 6 to its extended position (i.e., a movement of the bolt in the direction which is indicated by the arrow Pf1).

As explained above, the dimensions of the arms 15, **15*a* of the locating lever 7, the positions of the pivot pins 16, 18, and the locus of the stop 14 are selected in such a way that, when the effective length of the lever 7 is increased to the maximum value, the imaginary straight line extending from the tip 30 of the pallet 8 to the axis of the pivot pin 18 is located at a level above the pivot pin 16 (see FIG. 2). The housing 23 contains a support or anvil 32 against which the neighboring portions of the arms 15 and 15*a* abut when the locating lever 7 is held in the position of maximum effective length. The support 32 is located at a level below the pin 18 and prevents jackknifing of the lever 7 in the opposite direction (i.e., excessive movement of the pin 18 downwardly and below the aforementioned imaginary straight line between the tip 30 and the axis of the pin 18). When the lever 7 is moved to its position of maximum length, i.e., when the pivot pin 16 is located below the line connecting the tip 30 of the arm 15*a* with the axis of the pin 18, the line connecting the point 31 of contact between the pallet 8 of the lever 7 and the periphery of the cam 3 on the one hand and the axis of the pin 18 on the other hand is also located at a level above the pin 16 which connects the arms 15 and 15*a* to each other. This can be seen in FIG. 2. If one attempts to push the locking bolt 6 from the extended position of FIG. 1 or 2 to the retracted position of FIG. 3, 4 or 5, the locating lever 7 furnishes a self-locking action because the junction between its arms 15 and 15*a* bears against the support 12 with a force which increases in response to increasing pressure upon the bolt 6 in a direction counter to that indicated by the arrow Pf1. At the same time, the tip 30 of the lever arm 15*a* is urged with an increasing force against the stop 14 in the housing 23. The aforementioned torsion spring 33 holds the locating lever 7 in the position of FIG. 2. As explained above, the spring 33 performs the additional function of urging the lever 7 to the position which is shown in FIG. 2**, namely, to its position of maximum length.

In order to avoid undesirable collisions between the portion or post 13 of the tumbler **5*a* and the control lever 24 in the event of improper manipulation of the lock 1, the free end portion of the control lever 24 carries an actuating pawl 34 which constitutes a second component of the aforementioned mechanism or linkage and the front portion of which has a concave surface 35 engageable by the post 13. The configuration of the concave surface 35 is such that, when the parts of the lock 1 assume the positions shown in FIG. 4 (in which the post 13 is not in engagement with the pawl 34), the concave surface 35 is located in the path of counterclockwise movement of the post 13 along the endless circular path whose center is located on the axis of the shaft 2. On the other hand, when the parts assume the positions shown in FIG. 5, the concave surface 35 lies along the path of the radially outermost portion 36 of the post 13. Thus, the post 13 can move past the concave surface 35 as often as desired, either clockwise or counterclockwise. It will be seen that the post 13 can bypass the pawl 34 when the coupling lever 12 is held in the operative position of FIG. 2 or 5. On the other hand, when the coupling lever 12 assumes the inoperative position of FIG. 4 and the post 13 is caused to move in the direction of arrow Pf2, the post 13 engages the concave surface 35 and thereby causes the coupling lever 12 to move from the inoperative to the operative position, i.e., from the angular position of FIG. 4 to that which is shown in FIG. 5. The center of curvature of the concave surface 35 at the free end of the pawl 34 is located at one side of the symmetry plane which halves the pawl 34 and includes the axis of its pivot member 37 on the control lever 24. With reference to FIG. 4, such center of curvature is located at a level above the just mentioned plane. This means that the post 13 can bypass the concave surface 35 only when the coupling lever 12 assumes the operative position of FIG. 5, i.e., the center of curvature of the concave surface 35 is then located on the common axis of the shaft 2, cam 3 and tumblers 5 and 5*a*. Otherwise stated, the center of curvature of the concave surface 35 then coincides with the center of the arcuate path for the post 13 about the shaft 2**.

The pawl 34 is pivotable with reference to the control lever 24 and the latter carries a stop 38 which limits the extent of pivotal movement of the pawl 34 in a counterclockwise direction, as viewed in FIG. 3, about the axis of the pivot member 37. When the pawl 34 is caused to turn in a clockwise direction, as viewed in FIGS. 2 to 5, it must overcome the resistance of a spring 39 which reacts against a post or stud in the housing 23 and urges the pawl 34 in a counterclockwise direction. This renders it possible to rotate the tumbler **5*a* and its post 13 in a counterclockwise direction, as viewed in FIG. 4, without damaging the post 13 and/or the pawl 34 because the pawl 34 yields by overcoming the resistance of the spring 39**.

The locking bolt 6 is formed with an elongated slot 40 for a sturdy guide pin or stud 41 which is secured to one or both major side walls or panels of the housing 23. In addition, the locking bolt 6 has an extension or leg 43 which is adjacent to and can slide along the internal surface 42 of the housing 23. This ensures that the locking bolt 6 is not likely to jam during movement in or counter to the direction which is indicated by the arrow Pf1. The extension or leg 43 may constitute a separately manufactured component which is bolted, riveted, welded or otherwise secured to the main portion of the locking bolt 6.

In order to retrace the bolt 6 from the position of FIG. 2 to the position of FIG. 3, the tumblers 5, 5*a* must be moved to their predetermined positions in which the notches 4 are aligned with one another (see FIG. 4). By rotating the cam 3 in the counterclockwise direction, as viewed in FIGS. 2 to 5, the recess 10 of the lobe 11 on the cam 3 moves into register with and receives the pallet 8 of the arm 15*a* while the finger 9 of the arm 15*a* enters the aligned notches 4. Further rotation of the cam 3 in a counterclockwise direction results in movement of the lever 7 in a direction to the left and in attendant movement of the bolt 6 to the retracted position. The coupling lever 12 cannot oppose such movement since its function is to transmit motion from the lobe 11 to the locking bolt 6 when the latter is to move in the direction of arrow Pf1, i.e., toward the extended position.

The effective length of the locating lever 7 is reduced by the cam 3 preparatory to movement of the locking bolt 6 to its extended position shown in FIGS. 1 and 2. To this end, the cam 3 is rotated clockwise, as viewed in FIG. 3, so that the portion 11″ of its lobe 11 engages the pallet 8 and jacnknifes the lever 7 by pivoting the arm 15 clockwise about the pin 18 through the medium of the arm 15*a*. This moves the tip 30 of the arm 15*a* into aligment with or immediately against the stop 14 and causes the pivot pin 16 to move to the position of FIG. 4, i.e., to a level well above the pin 18 so that the abutment 17 of the housing 23 is located in the path of movement of the arm 15 when the locking bolt 6 is thereupon caused to move from the retracted position of FIG. 5 to the extended position shown in FIGS. 1 and 2. It will be noted that the effective length of the locating lever 7 is reduced in response to rotation of the tumbler 5*a* from its predetermined position to and beyond that position in which the post 13 of the tumbler 5*a* causes the coupling lever 12 (by way of the mechanism or linkage 24,34) to assume its operative position. The effective length of the locating lever 7 is increased in automatic response to movement of the locking bolt 6 to the extended position because the abutment 17 then causes th arm 15 to pivot in a counterclockwise direction, namely, from the position of FIG. 5 toward the position of FIG. 2. Thus, the arm 15 pivots counterclockwise, as viewed in FIG. 5, to increase the effective length of the locating lever 7 during movement of the locking bolt 6 to the extended position, and the arm 15 pivots clockwise to reduce the effective length of the locating lever when the cam 3 is rotated in a direction to move the portion 11″ of the lobe 11 against the pallet 8 while the latter extends into the recess 10 of the lobe.

An important advantage of the improved permutation lock 1 is that at least one tumbler must be moved from its predetermined position even before the locking bolt 6 can be shifted in the direction of arrow Pf1, i.e., from the retracted position of FIG. 3, 4 or 5 to the extended position of FIG. 1 or 2. Consequently, the lock 1 is highly likely to be successfully tempered with by an unauthorized person who is not familiar with the combination. Thus, the coupling lever 12 can be moved to the operative position of FIG. 5 through the medium of the control lever 24, pawl 34 and post 13 only when the tumbler 5*a* is moved from its predetermined position, and such movement of the tumbler 5*a* must be preceded by movements of all other tumblers (5) from their predetermined positions so that the positions of all four tumblers 5 and 5*a* are scrambled before the person who manipulates the lock 1 is capable of moving the locking bolt 6 to the extended position of FIG. 1 or 2. It follows that each and every movement of the locking bolt 6 back to the retracted position of FIG. 3, 4 or 5 must be preceded by a change in the position of each and every tumbler so that the notches 4 are returned into positions of register with one another and the pallet 8 of the locating lever 7 can enter the recess 10 and be entrained by the cam 3 in a direction to retract a portion of the bolt 6 into the housing 23. Otherwise stated, the movement of the coupling lever 12 to the operative position of FIG. 5 (preparatory to moving the locking bolt 6 to the extended position of FIG. 1 or 2) is delayed until after one or more tumblers move their notches 4 out of positions of register with the notch or notches 4 of the remaining tumbler or tumblers. Since the finger 9 of the locating lever 7 can enter the notches 4 only and alone when all of the tumblers assume their predetermined positions, opening of the lock 1 is necessarily preceded by a manipulation of the knob on the shaft 2 in the direction or directions such as to return all tumblers to their predetermined positions so that the pallet 8 will be able to enter the recess 10 and be entrained by the cam 3 while the latter rotates counterclockwise so that the portion 11′ of the lobe 11 bears against the pallet 8 and retracts the locking bolt 6 through the medium of the locating lever 7.

The coupling lever 12 need not necessarily be mounted on the locking bolt 6. However, the illustrated design is preferred at this time because the construction of the mechanism for moving the lever 12 to its operative position in response to angular displacement of a selected tumbler (5*a*) from its predetermined position is very simple, inexpensive, compact and reliable.

The utilization of a collapsible locating lever also exhibits numerous important advantages. Such lever (i.e., the lever 7) can be directly coupled to the bolt 6 and its length can be changed (increased) in automatic response to movement of the bolt 6 to the extended position by the simple expedient of providing the housing 23 with the stationary abutment 17 which is placed into the path of movement of the junction between the arms 15 and 15*a*. This renders it possible to rotate the knob with the shaft 2 and to lift the lever 7 so as to withdraw its finger 9 from the notches 4 of the tumblers 5, 5*a* prior to actual shifting of the locking bolt 6. The important feature is the shortening of the locating lever 7 so that the left-hand portion of the arm 15*a* can be lifted and brought behind the stop 14 before the bolt 16 is set in motion. In the next step, the delayed movement of the bolt 6 takes place before the lever 7 is stretched or elongated again. Mounting of the two-armed lever 17 (with a pivot pin 16 between the two arms) directly on the bolt 6 contributes to simplicity and compactness of the lock 1 and renders it possible to shorten the lever 7 by the simple expedient of pivoting the arm 15 clockwise about the pivot pin 18, i.e., about the locus of attachment to the locking bolt 6.

Permutation locks of the general class to which the present invention pertains are reliably closed (i.e., the locking bolt is reliably held in the extended position) if the cams which rotate the tumblers are disposed one after the other, as considered in one direction of rotation of the knob. This means that, when the locking bolt is to be moved to its extended position, it is necessary to rotate the knob a corresponding number of times in a direction to expel the locking bolt from the housing, namely, the number of such angular movements must exceed by one the number of tumblers. Thus, even if a permutation lock of the just outlined character is already closed to such an extent that the finger of the locating lever cannot immediately fall back into the notches of the tumblers but the knob has not been turned a requisite number of times (namely, n+1 times wherein n is the number of tumblers), further rotation of the knob by an unauthorized person would enable such person to ascertain at least certain features of the lock, i.e., at least the differences between the individual digits of the code or combination. This is prevented, in accordance with the invention, in that the post 13 is not placed on the uppermost tumbler 5, i.e., on the tumbler which is nearest to the cam 3 and which, therefore, is first to be moved from the predetermined position when the shaft 2 is rotated, but rather on a tumbler (5*a*) which is separated from the cam 3 by at least one intermediate tumbler. In the illustrated embodiment, the tumbler 5*a* which carries the post 13 is remotest from the cam 3; this means that the angular position of each and every tumbler must be changed before the post 13 causes a movement of the coupling lever 12 to the operative position of FIG. 5. Othewise stated, each and every intermediate tumbler 5 must be moved all the way to its exteme position before the tumbler 5*a* is turned so that its post 13 effects a movement of the coupling lever 12 to the operative position. Therefore, an unauthorized person cannot reach any valid conclusions regarding the combination of the lock 1. Thus, each movement of the locking bolt 6 to the extended position is invariably preceded by such scrambling of the tumblers that the closing of the lock 1 takes up a certain interval of time which is needed to displace the coupling lever 12 through the medium of the last tumbler 5*a*. Furthermore, and since there is need for a reasonable amount of manipulation prior to movement of the locking bolt 6 to extended position, there is no possibility of conveniently decoding the combination, even if such attempt is made by an experienced safecracker.

Permutation locks are often associated with electrical, electrooptical or other suitable devices which monitor the position of the locking bolt, especially with devices which indicate whether or not the locking bolt is held in the extended position. Such monitoring is to no avail or is of very little help, insofar as the reliability of the lock is concerned, if the number of tumblers which have left their predetermined positions when the locking bolt is in the extended position is small or zero. Thus, and since the lock 1 of the present invention is designed to move all of its tumblers (or at least one of its tumblers) from their predetermined positions before the coupling lever 12 is free to move the locking bolt 6 to the extended position, the combination of such a lock with electrical, electronic or other means for monitoring the position of the bolt is highly effective and invariably contributes to even greater reliability of the improved lock. The manner in which the shaft 2 and its cam 3 can cause the tumblers 5, 5*a* to move to and from their predetermined position is known in the art and can be analogous to that disclosed for instance in U.S. Pat. No. 3,176,486 granted Apr. 6, 1965 or in British Pat. No. 1,175,730 published Dec. 23, 1969.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalance of the appended claims.

I claim:

1. A permutation lock, comprising a housing; a locking bolt installed in and movable with reference to said housing between extended and retracted positions; a plurality of rotary tumblers in said housing; means for rotating said tumblers relative to each other to and from predetermined positions, said rotating means comprising a cam in said housing; locating means movable in said housing into engagement with said cam only in said predetermined positions of said tumblers so as to effect a movement of said bolt to one of said positions in response to rotation of said cam; and a coupling device movable in said housing to and from an operative position in which said device moves said bolt to the other of said positions in response to rotation of said cam, one of said tumblers having means for effecting a movement of said device to said operative position in response to movement of said one tumbler from the predetermined position thereof so that such movement of said one tumbler must precede the movement of said bolt to said other position.

2. The lock of claim 1, wherein said tumblers are rotatable about a common axis and each of said tumblers has a peripheral surface provided with a notch, said notches being aligned with each other, as considered in parallelism with said common axis, in said predetermined positions of said tumblers and said cam having a peripheral surface provided with a recess, said locating means including a first portion receivable in said recess and a second portion receivable in said notches only in said predetermined positions of said tumblers so that each movement of said bolt to said one position thereof must be preceded by movement of all of said tumblers to said predetermined positions in order to enable said first and second portions of said locating means to respectively enter said recess and said notches.

3. The lock of claim 2, wherein said locating means comprises a lever and further comprising pivot means articulately connecting said lever to said bolt.

4. The lock of claim 1, wherein said cam comprises a motion transmitting portion arranged to move along an arcuate path in response to rotation of said cam, said coupling device being interposed between the path of movement of said motion transmitting portion and said bolt in the operative position of said device.

5. The lock of claim 4, further comprising means for connecting said coupling device with said bolt.

6. The lock of claim 5, wherein said coupling device comprises a lever and said connecting means comprises a pivot member articulately connecting said lever with said bolt.

7. The lock of claim 6, wherein said movement effecting means comprises a projection on said one tumbler and further comprising a mechanism for pivoting said lever to said operative position under the action of said projection in response to rotation of said one tumbler from said predetermined position thereof.

8. The lock of claim 7, wherein said mechanism comprises a linkage and said projection is arranged to move along an arcuate path in response to rotation of said one tumbler, said linkage including a component extending into the path of movement of said projection when said lever is out of said operative position while said one tumbler is rotated away from said predetermined position thereof.

9. The lock of claim 1, wherein said one position of said bolt is said retracted position.

10. The lock of claim 9, wherein said locating means comprises a lever of variable effective length, and further comprising means for articulately connecting said lever to said bolt, said cam having means for reducing the length of said lever in the retracted position of said bolt and in response to rotation of said cam to move said one tumbler from said predetermined position preparatory to movement of said coupling device to its operative position.

11. The lock of claim 10, wherein said housing comprises a stop and said lever includes a portion which engages said stop in response to a reduction of the length of said lever by said cam.

12. The lock of claim 11, wherein said lever comprises a first section which is articulately connected with said bolt and a second section which is articulately connected with said first section so that the effective length of said lever can be changed by moving at least one of said sections with reference to the other of said sections.

13. The lock of claim 12, wherein said stop engaging portion is provided on said second section of said lever.

14. The lock of claim 12, wherein said length reducing means of said cam is arranged to pivot said first section of said lever with reference to said bolt in a predetermined direction by way of said second section.

15. The lock of claim 14, further comprising abutment means provided in said housing in the path of movement of said first section with said bolt toward the extended position of said bolt so as to pivot said first section counter to said predetermined direction with attendant lengthening of said lever in response to movement of said bolt to said extended position.

16. The lock of claim 1, wherein said tumblers are rotatable about a common axis and said rotating means comprises means for moving at least one additional tumbler from said predetermined position not later than on movement of said one tumbler from said predetermined position preparatory to movement of said coupling device to said operative position.

17. The lock of claim 16, wherein said tumblers include a first tumbler nearest to said cam and a last tumbler remotest from said cam and constituting said one tumbler, said rotating means being arranged to effect a movement from said predetermined position of each tumbler between said cam and said one tumbler before said one tumbler is moved from its predetermined position preparatory to movement of said coupling device to said operative position.

18. The lock of claim 1, wherein said coupling device comprises a lever and further comprising pivot means securing said lever to said locking bolt for pivotal movement between said operative position and a second position, and means for moving said lever to said second position in response to movement of all of said tumblers to said predetermined positions thereof.

19. The lock of claim 18, further comprising retaining means for releasably holding said lever in at least one of said positions thereof.

20. The lock of claim 19, wherein said retaining means comprises magnet means in said housing.

21. The lock of claim 20, wherein said one position of said coupling lever is said second position.

22. The lock of claim 19, wherein said retaining means comprises detent means for releasably holding said coupling lever in either of said positions thereof.

23. The lock of claim 19, further comprising a motion transmitting mechanism interposed between said portion of said one tumbler and said coupling lever to move the latter to said operative position in response to rotation of said one tumbler from its predetermined position, said retaining means being arranged to cooperate with said mechanism to releasably hold said coupling lever in said second position.

24. The lock of claim 1, wherein said cam comprises means for moving said coupling device from said operative position in response to rotation of said cam.

25. The lock of claim 24, wherein said means for moving said coupling device from said operative position comprises a lobe on said cam.

26. The lock of claim 1, further comprising a mechanism interposed between said movement effecting means of said one tumbler and said coupling device to move said coupling device to said operative position in response to movement of said one tumbler from the predetermined position thereof, said mechanism comprising a control lever pivotally connected with said housing and means for movably connecting said control lever with said coupling device.

27. The lock of claim 26, wherein said movement effecting means comprises a projection on said one tumbler.

28. The lock of claim 26, wherein said coupling device comprises a second lever pivotally connected to said locking bolt and said means for movably connecting said control lever with said coupling device comprises a pin-and-slot connection between said levers.

29. The lock of claim 28, wherein said pin-and-slot connection comprises a pin on said coupling lever and an elongated slot provided in said control lever and receiving a portion of said pin.

30. The lock of claim 29, wherein said housing comprises a first wall adjacent to said cam and a second wall remote from said cam, said control lever being pivotally connected with said second wall.

31. The lock of claim 26, wherein said control lever is a prefabricated stamping having bent-over cheeks forming part of said means for movably connecting said control lever with said coupling device.

32. The lock of claim 1, further comprising means for yieldably biasing said locking bolt to said extended position with a predetermined force.

33. The lock of claim 32, wherein said locating means comprises a lever of variable length, and further comprising means for articulately connecting said lever with said locking bolt and means for reducing the effective length of said lever prior to movement of said locking bolt to said extended position, said means for reducing the effective length of said lever including means for applying to said lever a second force which at most equals said predetermined force so that a reduction of the effective length of said lever does not entail a movement of said locking bolt to the extended position.

34. The lock of claim 1, wherein said coupling device comprises a first lever having a first pallet adjacent to said cam and further comprising means for pivotally connecting said lever to said locking bolt for movement between said operative position and a second position, said cam having a lobe arranged to engage said pallet and to thereby move said locking bolt to said extended position in response to rotation of said cam in a predetermined direction while said locking bolt is held in said operative position, said cam further having a recess and said tumblers having notches which are aligned with one another in said predetermined positions of said tumblers, said locating means comprising a second lever having a first arm and a second arm, a first pivot member articulately connecting said first arm to said locking bolt and a second pivot member articulately connecting said arms to one another, said second arm having a tip remote from said second pivot member, a second pallet adjacent to said tip and receivable in said recess, and a finger receivable in said notches when all of said tumblers assume their predetermined positions, said cam being arranged to pivot the arms of said second lever relative to each other through the medium of said second pallet and to first positions preparatory to movement of said locking bolt to said extended position, said second pivot member being located at one side of a straight line connecting said tip with said first pivot member when said arms assume said first positions.

35. The lock of claim 34, further comprising abutment means provided in said housing and arranged to pivot the arms of said second lever to second positions in response to movement of said locking bolt to said extended position, said second pivot member being located at the other side of said line in the second positions of said arms.

36. The lock of claim 35, further comprising support means provided in said housing and arranged to hold said arms of said second lever against movement beyond said second positions thereof.

37. The lock of claim 36, wherein said bolt is reciprocable along a substantially horizontal path and said second pivot member is located at a level below said line in the second positions of said arms.

38. The lock of claim 37, wherein a line connecting the axis of said first pivot member with the locus of contact between said first pallet and said cam in the second positions of said arms is located at a level below said second pivot member.

39. The lock of claim 1, wherein said coupling device is movable between said operative position and an inoperative position and said movement effecting means comprises a post provided on said one tumbler and arranged to move along an arcuate path, and further comprising a mechanism installed in said housing and arranged to transmit motion from said post to said coupling device in response to rotation of said one tumbler from said predetermined position thereof, said mechanism comprising a control member pivoted to said housing and articulately connected with said coupling device, a pawl and means for pivotally connecting said pawl with said control member, said pawl having a surface extending into the path of movement of said post in the inoperative position of said coupling device so that said post displaces said pawl and said pawl causes said control member to move said coupling device to operative position in response to movement of said post along said path while said cam is rotated to move said one tumbler from its predetermined position.

40. The lock of claim 39, wherein said surface of said pawl is a concave surface, the center of curvature of said concave surface coinciding with the center of curvature of said arcuate path in the operative position of said coupling device so that said post can bypass said pawl.

41. The lock of claim 40, wherein said pawl has a symmetry plane including the pivot axis of said connecting means, the center of curvature of said concave surface being located at one side of said plane.

42. The lock of claim 39, further comprising stop means for limiting the extent of pivotal movement of said pawl with reference to said control member.

43. The lock of claim 42, wherein said post is arranged to pivot said pawl in a predetermined direction against said stop means and further comprising biasing means arranged to yieldably oppose the pivotal movement of said pawl counter to said predetermined direction.

* * * * *